United States Patent [19]

Miyamoto et al.

[11] Patent Number: 4,825,491

[45] Date of Patent: May 2, 1989

[54] METHOD FOR TREATING TEXTILE MATERIAL IN CONTINUOUS LENGTH

[75] Inventors: Mitsuyasu Miyamoto, Itami; Osamu Ishimaru, Matsubara; Nobuyoshi Fukube, Takatsuki, all of Japan

[73] Assignee: Hisaka Works, Ltd., Osaka, Japan

[21] Appl. No.: 609,844

[22] Filed: May 14, 1984

Related U.S. Application Data

[60] Continuation of Ser. No. 465,837, Feb. 14, 1983, abandoned, which is a division of Ser. No. 313,320, Oct. 20, 1981, Pat. No. 4,392,365, which is a continuation of Ser. No. 213,615, Dec. 5, 1980, abandoned, which is a continuation of Ser. No. 84,072, Oct. 12, 1979, abandoned.

[30] Foreign Application Priority Data

Oct. 18, 1978 [JP] Japan ..... 53-127265
Feb. 24, 1979 [JP] Japan ..... 54-23235

[51] Int. Cl.[4] ..... D06B 3/28
[52] U.S. Cl. ..... 8/152
[58] Field of Search ..... 8/152; 68/19, 177, 178, 68/184

[56] References Cited

U.S. PATENT DOCUMENTS

| | | | |
|---|---|---|---|
| 3,510,251 | 5/1970 | Fujii et al. . | |
| 3,780,544 | 12/1973 | Turner et al. | 68/177 |
| 3,837,187 | 9/1974 | Trullas | 68/177 X |
| 3,924,424 | 12/1975 | Watanabe et al. | 68/177 |
| 3,949,580 | 4/1976 | Trullás . | |
| 3,952,558 | 4/1976 | Sandberg et al. | 68/177 |
| 4,019,351 | 4/1977 | Mizutani et al. | 68/177 |
| 4,210,005 | 7/1980 | Trullas | 68/177 X |

FOREIGN PATENT DOCUMENTS

| | | | |
|---|---|---|---|
| 934645 | 11/1955 | Fed. Rep. of Germany | 68/177 |
| 2143695 | 9/1971 | Fed. Rep. of Germany . | |
| 2212836 | 9/1972 | Fed. Rep. of Germany . | |
| 7409999 | 9/1974 | Fed. Rep. of Germany . | |
| 0011444 | 6/1967 | Japan . | |
| 6431 | 2/1973 | Japan | 68/177 |
| 0121575 | 9/1975 | Japan . | |
| 0014880 | 2/1978 | Japan . | |
| 0130369 | 11/1978 | Japan . | |
| 1263759 | 2/1972 | United Kingdom . | |
| 1296427 | 11/1972 | United Kingdom . | |
| 1390000 | 4/1975 | United Kingdom . | |
| 1513887 | 6/1978 | United Kingdom . | |
| 1547367 | 6/1979 | United Kingdom . | |

OTHER PUBLICATIONS

"Canal Jet", Canal., Apr. '71.

*Primary Examiner*—Philip R. Coe
*Attorney, Agent, or Firm*—Emmanuel J. Lobato; Robert E. Burns

[57] ABSTRACT

A continuous method of rapidly and uniformly treating textile fabrics in an endless loop configuration. The endless loop is continuously advanced longitudinally so that runs advance successively through a residence bath, for wet treatment in a treating liquor, contained in a partially filled elongated, tubular vessel and increasing gradually in depth in the direction in which the textile fabric is advanced in zigzag form. Suction is taken on the residence bath for piling control of the textile fabric therein and to develop a jet flow of treating liquor therefrom flowed in an enclosed path outside of the residence bath through which the textile fabric is rapidly transferred substantially zigzag free from one end of the residence bath and back to the other immersed in the jet flow liquor as the treating liquor is recirculated by return to the residence bath. The jet flow treating liquor is discharged from the enclosed path to a level above the level of the residence bath and it and accompanying textile fabric are deflected by a deflector panel adjustably set inclined relative to the horizontal, in dependence upon the textile material of the fabric for beating and relaxing the textile material. The textile fabric is deflected back into the residence bath with improved controlled compaction and proper piling thereof for advancing smoothly in the residence bath. Textile fabric and jet flow are directed onto a guide path having a plate onto which the textile fabric falls and extending inclined into the residence bath and having side plates for smooth guidance of the advancing textile fabric.

38 Claims, 3 Drawing Sheets

METHOD FOR TREATING TEXTILE MATERIAL IN CONTINUOUS LENGTH

This is a continuation application of application Ser. No. 465,837 filed Feb. 14, 1983, and now abandoned, which is a divisional application of Ser. No. 313,320 filed Oct. 20, 1981 now patented as U.S. Pat. No. 4,392,365 and which is a continuation of application Ser. No. 213,615 filed Dec. 5, 1980, and now abandoned and which is a continuation application of application Ser. No. 084,072 filed Oct. 12, 1979, and now abandoned.

BACKGROUND OF THE INVENTION

1. Field of the Invention

The invention relates to a method for treating textile material which is in a continuous loop. More particularly, the invention relates to a method for the wet treatment, such as dyeing or scouring, of a textile material, such as knitted, woven or non-woven fabrics, which is in a continuous loop, and which involves circulating said textile material with a treating liquor.

2. Description of Prior Art

Jet treatment of textile material in an endless loop form is well known, wherein the textile material is treated by circulating the textile material together with a treating liquor while allowing the transient residence of the textile material in a bath, said bath being arranged in an approximately horizontal position.

In such jet treatment of a textile material, proposals have recently been made for making the treatment more efficient, whereby the circulation of the treating liquor and the textile material is carried out at a high speed (see, for example, Japanese Patent Publication No. 52-37112). By increasing the circulation speed of the treating liquor, as well as increasing the circulation speed of the textile material, the treating liquor is in more frequent contact with the textile material, so that the treating time decreases, thereby resulting in a more efficient operation. On the other hand, proposals have been made, for the purpose of economizing the treatment, whereby the amount of the treating liquor is decreased so that the treatment takes place with a low liquor ratio (see, for example, Japanese Laid-open Patent Specification (Kokai) No. 53-130369). The total volume of the treating liquor is decreased by inclining the bath, which lowers the liquor ratio so that the consumption of energy is decreased and the necessary amount of dyes or treating agents is also decreased which allows more economical treatment.

However, such a low liquor ratio treatment may have a drawback in that the textile material is not smoothly transferred in the bath due to the small volume of the treating liquor and, thus, it becomes difficult to obtain an even treatment of the textile material. Particularly, in the case where such a low liquor ratio treatment is applied when rapid treatment takes place, as mentioned above, the problem that the textile material is not smoothly moved through the bath makes it impossible to practically carry out such rapid treatment of the textile material. This is because a complex entanglement of the textile material occurs due to the unsmooth movement thereof in the bath, so that the treatment operation is often interrupted.

SUMMARY OF THE INVENTION

It is the primary object of the present invention to eliminate the above-mentioned problems in the jet treatment of textile material and to provide a method by which the jet treatment of textile material in a continuous loop can be carried out economically and efficiently at a low liquid ratio and at a high speed.

The above object and other objects which will become apparent from the descriptions given hereinbelow can be achieved by the method of the present invention having the following construction.

According to the present invention, there is provided a method for treating a textile material in a continuous loop, comprising circulating said textile material in a circular treating passageway comprised of a portion for allowing the transient residence of the textile material while transferring in an approximately horizontal position, but in a zigzag form in a treating liquor and another portion for moving the textile material through a rapid flow of the treating liquor, characterized in that the residence portion is inclined so that the depth of the treating liquor increases gradually in the advancing direction of the textile material and the textile material is transferred in this portion with the slopewise flow of the treating liquor and in that the textile material transferred through the rapid flow of the treating liquor strikes against a baffle plate, within the circular treating passageway, at a high speed.

The present invention also provides an apparatus for treating a textile material in a continuous loop, comprising a circular treating passageway comprised of a laterally elongated bath for allowing the transient residence of the textile material while transferring the textile material in a treating liquor in a zigzag form, a section for jetting the treating liquor connected to the outlet portion of the residence bath, and a passageway for transferring the textile material along with a rapid flow of the treating liquor, said passageway having ends connected to the inlet portion of the bath and to the treating liquor jetting section, and a treating liquor circulating passageway leading to the treating liquor jetting section via at least one port for intaking the treating liquor provided in the bath, a suction pipe, a pump and a heat exchanger, characterized in that the bath is inclined so as to gradually increase the depth of the treating liquor in the advancing direction of the textile material and in that a baffle plate is provided at the inlet portion of the bath at a prescribed interval from the outlet end of the transferring passageway so that the textile material strikes against the baffle plate.

In the preferred embodiments of the above-mentioned method of the present invention, some other means are introduced for making the movement of the textile material in the residence bath smoother and for attaining other advantageous effects as mentioned hereinbelow.

DESCRIPTION OF PREFERRED EMBODIMENTS

In the present invention, the rapid treatment of a textile material in a continuous loop, is made possible by moving the textile material with a rapid flow of a treating liquor and causing the textile material to strike against a baffle plate at the inlet portion of a bath, said baffle plate ensuring the smooth movement of the textile material in the bath and then from the bath to a conduit passageway in which the textile material is moved along with the treating liquor which is flowing rapidly. The smooth movement of the textile material is further promoted, according to the present invention, by the inclination of the bath so that the depth of the treating liquor gradually increases in the advancing direction of the textile material. Thus, in the present invention, since the movement of the textile material in the circular treatment passageway can be made very smoothly, a low liquor ratio can also be achieved since the amount of the treating liquor can be easily decreased.

The present invention will now be explained in detail below, with respect to the preferred embodiments thereof, with reference to the accompanying drawings.

Figure 1:
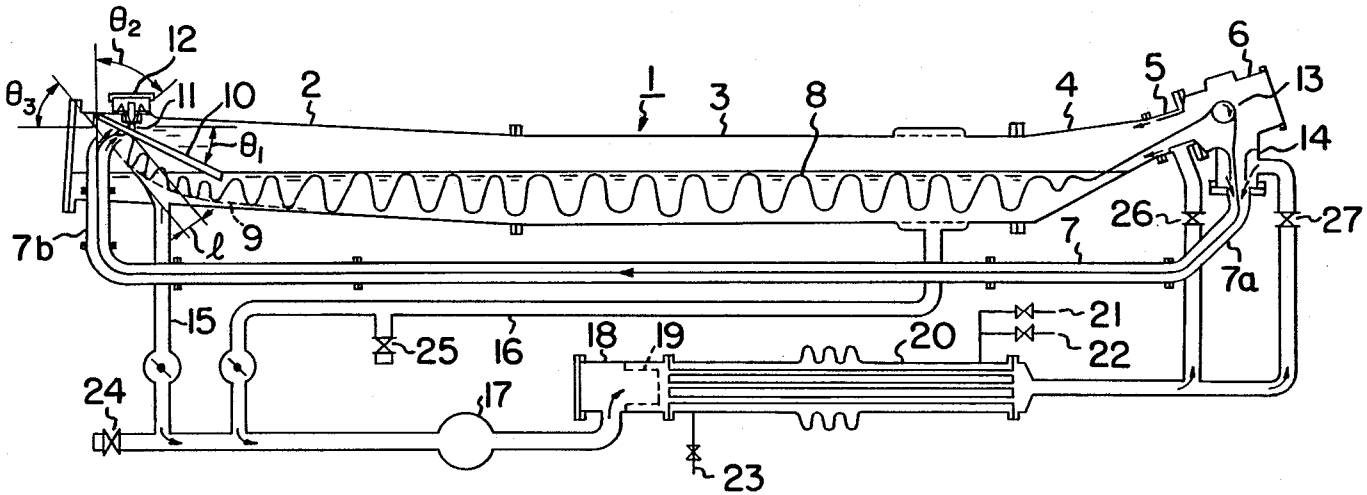
FIG. 1 is a cross-sectional view schematically illustrating a preferred embodiment of the apparatus of the present invention.

Referring now to FIG. 1, a residence bath 1 is composed of a rear portion 2, a middle portion 3 and a front portion 4. The rear portion 2 is inclined and the angle of the inclination is preferably not more than 5° with respect to a horizontal plane. The middle portion 3 is approximately horizontal and the front portion 4 is in a taper form and inclined at a greater angle than the rear portion. Connected to the front portion 4 are jetting section 5 for jetting the treating liquor in a direction opposite to the advancing direction of the textile material and a header section 6. The header section 6 is formed in an approximate T-shape and in the central portion thereof a guide roll 13 is provided while in the lower portion a section 14 for jetting the treating liquor is provided.

A transferring passageway 7 for rapidly transferring the textile material being treated is connected, at its inlet portion 7*a*, to the lower end of the treating liquor jetting section 14 and is communicated, at its outlet portion 7*b*, with the rear portion 2 of the bath 1 in such a manner that the outlet end of the passageway 7 is projected into the rear portion 2. The inlet portion 7*a* is inclined and the angle of inclination is preferably from 30° to 60°.

A circular treating passageway is thus formed by the bath 1, a section 5 for jetting the treating liquor in a direction against the current, a header section 6 and a transferring passageway 7. The portion of the textile material 8 in the bath 1 is moved in such a manner that the textile material transiently stays within the bath in a zigzag form and is moved in the transferring passageway 7 in an approximately straight form.

In the inside of the rear portion 2 of the bath 1, a baffle plate 10 is provided so as to cover the open end of the outlet portion 7*b* of the passageway 7 with a prescribed interval from the open end, so that the textile material coming out from the passageway 7 at a high speed directly strikes against the baffle plate. In the baffle plate many holes are formed and the major part of the treating liquor carried with the textile material is passed through the holes and separated from the textile material at the time when the textile material strikes against the baffle plate. It is preferable that the baffle plate 10 be inclined and, in the apparatus illustrated in FIG. 1, the angle of inclination of the baffle plate can be changed by a joint 11. Further, the interval between the baffle plate and the open end of the outlet portion 7*b* of the passageway 7 is adjustable by means of a guide shaft 12. The position and the angle of inclination of the baffle plate 10 can be set as desired. However, it is preferable that the angle $\theta_1$, the distance and the angle $\theta_2$, as shown in FIG. 1, are in ranges of from 20° to 45°, from 100 mm to 150 mm and from 50° to 80°, respectively.

Figure 2:
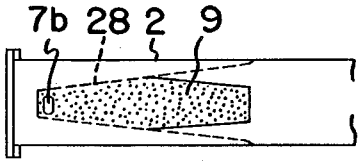
FIG. 2 is a schematical plan view illustrating the perforated plate portion of the apparatus illustrated in FIG. 1.

Below the baffle plate 10, an inclined perforated plate 9 is provided so that as the textile material 8 strikes against the baffle plate 10 it falls onto the perforated plate and, then, is advanced smoothly. The angle of inclination of the perforated plate 9 is preferably from 30° to 70° at the angle $\theta_3$ as shown in FIG. 1. At both sides of the perforated plate 9, a pair of plates 28 for preventing the textile material from moving in a zigzag direction is provided as shown in FIG. 2. The pair of plates is arranged to have an interval gradually increasing in the advancing direction of the textile material so that the textile material which falls onto the perforated plate is advanced without being entangled.

In the apparatus in FIG. 1, there are further provided suction pipes 15 and 16 for removing the treating liquor from the bath 1 via the intaking ports provided on the bath as well as a pump 17, a filter 18 with a wire net 19, a heat exchanger 20, a water feeding pipe 21, a steam feeding pipe 22, a drainage pipe 23 and regulating valves 24, 25, 26 and 27.

The operation of the apparatus will be illustrated below with reference to FIG. 1.

The textile material 8 comes out from the bath 1, is passed through the guide roll 13 and the treating liquor jetting section 14 and strikes against the wall of the inclined inlet portion 7*a* of the passageway 7 by being carried with the jet flow of the treating liquor fed from the treating liquor jetting section 14 in the circular treating passageway. The inclination of the inlet portion 7*a* can produce an impact effect on the textile material and, in addition, decrease the flow resistance of the rapid treating liquor flow produced by the treating liquor jetting section 14 to ensure a very high speed flow of the treating liquor. Thus, it is possible to make the running speed of the textile material being transferred in the passageway as high or higher than 300 m/min, particularly 300 to 600 m/min.

Since the passageway 7 has a relatively small diameter, the textile material 8 passes through this passageway in an approximately straight form and strikes against the baffle plate 10 immediately after coming out from the outlet portion 7*b*. At this time, the textile material gets an impact effect and, concurrently, the major part of the treating liquor carried with the textile material is passed through the holes formed in the baffle plate and separated from the textile material. The angle of inclination and the position of the baffle plate can be adjusted as desired as mentioned hereinabove and, thus, it is possible to effect the treatment of various types of textile materials by adjusting the angle of inclination and the position of the baffle plate depending upon the type, nature or the like of the textile material to be treated.

The perforated plate 9 is formed so as to gradually decrease the angle of inclination in the advancing direction of the textile material and, in addition, the plates 28 for preventing the zigzag movement of the textile material are arranged so as to gradually increase the interval therebetween. Therefore, the textile material falls onto the perforated plate 9 after striking the baffle plate 10 and is arranged in order and transferred forward successively and smoothly.

The textile material thus fed into the rear portion 2 of the bath 1 is then transferred from the middle portion 3 to the front portion 4, according to the advancing flow of the treating liquor, in a zigzagged mass form. The inclination of the rear portion 2, as hereinbefore mentioned ensures the smooth movement of the textile material and produces an advantageous effect in decreasing the required volume of the treating liquid in the bath 1.

The textile material 8 at the front portion 4 of the bath 1 is drawn up into the inside of the header section 6 through the guide roll 13. At the time the textile material 8 is drawn up, the textile material is subjected to the action of the countercurrent flow of the treating liquor produced by the section 5 for jetting the treating liquor in the countercurrent direction to loosen the possible entanglement of the textile material, whereby the textile material can again be smoothly guided to the treating liquor jetting section 14.

Since the header section 6 is arranged, by the inclination of the front portion 4, so as to take a position higher than the level of the treating liquor in the residence bath, the guide roll 13 becomes located in a gaseous area; thereby, the rapid movement of the textile material in this section can easily be achieved.

It is preferable that the level of the treating liquor in the residence bath is set so as to be at the middle level of the middle portion 3. In such a condition, since the striking against the baffle plate 10 and the falling onto the perforated plate 9 is carried out within a gaseous area, the separation of the textile material from the treating liquor is effected very efficiently and produces a high impact effect on the textile material and the entanglement of the textile material being treated is effectively avoided.

The treating liquor taken out from the intaking ports of the bath 1 is forwarded to the pump 17 via the suction pipes 15 and 16 and, then, passed through the filter 18 and heated by the heat exchanger 20. Then, a part of the treating liquor is fed to the treating liquor jetting section 14 via the regulating valve 27 and the remaining liquor is fed to the section 5 for jetting the treating liquor in the countercurrent direction via the regulating valve 26.

Figure 3:
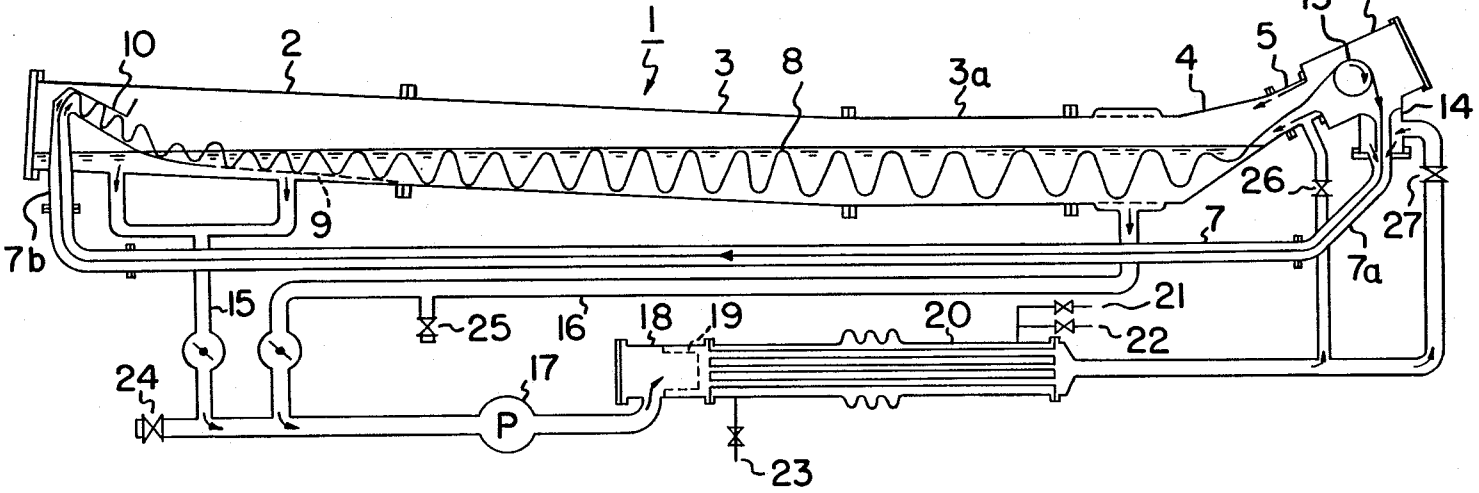
FIG. 3 is a cross-sectional view schematically illustrating another preferred embodiment of the apparatus of the present invention.

In the apparatus illustrated in FIG. 3, the baffle plate 10 is fixed. In this apparatus, the middle portion of the bath is composed of two parts 3 and 3a, in which the part 3 is inclined at an angle substantially the same as that of the rear portion 2, whereby the smooth movement of the textile material in the bath and the decrease of the liquid ratio can be attained more effectively.

Figure 4:
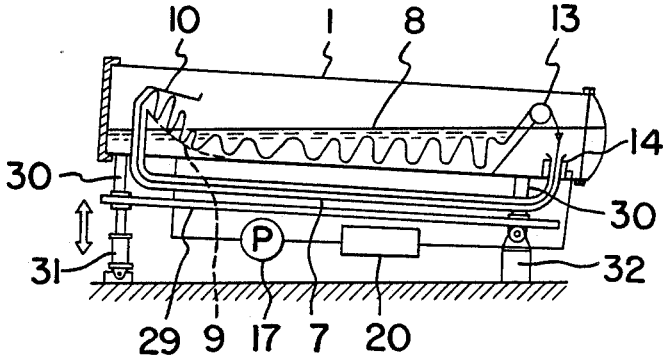
FIG. 4 is a cross-sectional view schematically illustrating a further embodiment of the apparatus of the present invention.

In the apparatus illustrated in FIG. 4, the bath 1 is formed in one body and the baffle plate 10 is fixed as in the apparatus illustrated in FIG. 3. This apparatus has means for properly adjusting the inclination of the bath 1 depending upon the temperature of the treating liquor, the type of the textile material or the like. The bath 1 is supported by a trestle 29 through legs 30 and a side of the trestle positioned at the inlet side of the residence bath is supported by a lifting mechanism 31 such as an air cylinder, hydraulic cylinder or jack. The lifting mechanism 31 can be moved upward and downward and stopped at a desired position. The other side of the trestle is supported on a prop 32, the upper portion of which is pivotable around a pivoted shaft. Thus, the residence bath can be inclined at a desired angle by the action of the lifting mechanism 31. The treating liquor circulating passageway including the pump 17 and the heat exchanger 20 may be fixed independently of the inclining movement of the residence bath or may be designed so as to be able to incline corresponding to the inclination of the residence bath.

In the embodiments illustrated above, the transferring passageway 7 is provided below the residence bath 1. However, if desirable or appropriate, the passageway 7 may be provided above the bath 1.

According to the method and apparatus of the invention as illustrated hereinabove, it is possible to practice the very efficient rapid treatment of textile material in a continuous loop and, also, the economical treatment of such textile material at a low liquor ratio. The smooth movement and the rapid transfer of the textile material in the present invention makes it possible to produce uniform treatment on the textile material owing to the increased contact of the treating liquor with the textile material. Further, since the textile material receives a beating effect when striking against the baffle plate, it is unlikely that wrinkles in the textile material will become fixed. Furthermore, in the present invention, it is possible to carry out the relaxing of knitted or woven fabrics made from a textured yarn or the creping of woven fabrics made from a high twist yarn very effectively, through the impact effect obtainable at the time when the material strikes against the baffle plate. Accordingly, the method and apparatus of the present invention may be utilized for general purpose treatments.

What is claimed is:

1. A method for treating a textile material in a continuous loop form, comprising circulating said textile material in a circular treating passageway comprised of a portion for allowing the transient residence of the textile material while transferring in an approximately horizontal position, but in a zigzag form, in a treating liquor and another portion for moving the textile material through a rapid flow of the treating liquor, characterized in that the residence portion is inclined so that the depth of the treating liquor increases gradually in the advancing direction of the textile material and the textile material is transferred in this portion with the slopewise flow of the treating liquor and in that the textile material transferred through the rapid flow of the treating liquor strikes against a baffle plate, disposed within an area above the level of the treating liquor in the treating passageway, at a high speed and subsequently allowing it to fall on to a perforated plate below the baffle plate.

2. A method according to claim 1, wherein the inclination of the residence portion is adjusted as desired.

3. A method according to claim 1, wherein the major part of the treating liquor carried with the textile material is separated from the textile material at the time when the textile material strikes against the baffle plate.

4. A method of treating a textile material in a loop comprising, advancing textile material longitudinally in an elongated treating bath of treating liquor while in a loop configuration, for maintaining the textile material in residence for wet treatment in the treating bath, taking a suction from the treating bath and effecting a jet flow of treating liquor along an enclosed path outside of the treating bath for recirculating the treating liquor back to the treating bath and for advancing the textile material longitudinally, while the textile material is advancing directing its travel out of the treating bath into said jet flow, continuously discharging from said enclosed path treating liquor of the jet flow for return back into the treating bath above the level of the treating bath and ejecting the textile material from the jet flow enclosed path when treating liquor of the jet flow is discharged for return thereof back into the treating bath, impacting the advancing textile material accompanied by treating liquor in an area above the level of the treating bath after ejection from the jet flow enclosed path and prior to return of the advancing textile material back into the treating bath, and after impacting the advancing textile material allowing the textile material to fall onto a plate disposed extending into said treating bath and configured so that the textile material thereon is advanced without entangling, returning the textile material back into the treating bath for advancement therein.

5. A method of treating a textile material in a loop according to claim 4, including continuously advancing it through said treating bath and said jet flow of treating liquor.

6. A method of treating a textile material in a loop according to claim 5, including applying heat to the treating liquor taken by suction from the treating bath prior to development of the jet flow thereof.

7. A method of treating a textile material in a loop comprising, advancing textile material longitudinally in an elongated treating bath of treating liquor while in a loop configuration, for maintaining the textile material in residence for wet treatment in the treating bath, taking a suction from the treating bath and effecting a jet flow of treating liquor along an enclosed path outside of the treating bath for recirculating the treating liquor back to the treating bath and for advancing the textile material longitudinally through said jet flow, while the textile material is advancing directing its travel out of the treating bath into said jet flow, continuously discharging from said enclosed path treating liquor of the jet flow for return thereof back into the treating bath above the level of the treating bath and ejecting the textile material from the jet flow enclosed path when the treating liquor of the jet flow is discharged for return back into the treating bath, impacting the advancing textile material accompanied by treating liquor in an area above the level of the treating bath and removing treating liquor therefrom after ejection from the jet flow enclosed path and prior to return of the advancing textile material back into the treating bath, and after impacting the advancing textile material allowing the textile material to fall onto a perforated plate disposed extending into said treating bath and configured so that the textile material thereon is advanced without entangling, returning the textile material back into the treating bath for advancement therein.

8. A method of treating a textile material in a loop comprising, advancing textile material longitudinally in an elongated treating bath of treating liquor while in a loop configuration, for maintaining the textile material in residence for wet treatment in the treating bath, effecting a jet flow of treating liquor along an enclosed path outside of the treating bath for recirculating the treating liquor back to the treating bath and for advancing the textile material longitudinally through said jet flow, while the textile material is advancing directing its travel out of the treating bath into said jet flow, continuously discharging from said enclosed path treating liquor of the jet flow for return thereof back into the treating bath above the level of the treating bath and ejecting the textile material from the jet flow enclosed path when treating liquor from the jet flow is discharged for return back into the treating bath, impacting the advancing textile material accompanied by treating liquor in an area above the level of the treating bath after ejection from the jet flow enclosed path and directing return of treating liquor and the advancing textile material back into the treating bath, and after impacting the advancing textile material allowing the textile material to fall onto a perforated plate disposed extending into said treating bath and configured so that the textile material thereon is advanced without entangling, returning the material back into the treating bath for advancement therein.

9. A method of treating a textile material in a loop comprising,advancing a knitted, non-woven or woven textile material made of twist yarn longitudinally in an elongated treating bath of treating liquor while in zigzag form in a loop configuration, for maintaining the textile material in residence for wet treatment in the treating bath, taking a suction from the treating bath and effecting advancement of the textile material in said treating bath and effecting a jet flow of treating liquor along an enclosed path outside of the treating bath for recirculating the treating liquor back to the treating bath and for advancing the textile material longitudinally,while the textile material is advancing directing its travel out of the treating bath into said jet flow, continuously discharging from said enclosed path treating liquor of the jet flow for return thereof back into the treating bath above the level of the treating bath and ejecting the textile material from the jet flow enclosed path when treating liquor of the jet flow is discharged for return thereof into the treating bath, relaxing the knitted, non-woven or woven fabric by impacting the advancing textile material accompanied by treating liquor in an area above the level of the treating bath after ejection from the jet flow enclosed path and prior to the return of the advancing textile material back into the treating bath, and after impacting the advancing textile material allowing the textile material to fall onto a plate disposed extending into said treating bath and configured so that the textile material thereon is advanced without entangling, returning the textile material back into the treating bath for advancement therein.

10. A method of treating a textile material in a loop according to claim 9, including continuously advancing it through said treating bath and said jet flow of treating liquor, and in which said twist yarn is a high twist yarn.

11. A method of treating a textile material in a loop comprising, advancing textile material in zigzag form longitudinally in an elongated treating bath of treating liquor while in a loop configuration, for maintaining the textile material in residence for wet treatment in the treating bath, taking a suction from the treating bath and effecting a jet flow of treating liquor along an enclosed path outside of the treating bath for recirculating the treating liquor back to the treating bath and for advancing the textile material longitudinally through said jet flow, while the textile material is advancing in said treating bath subjecting it to a counterflow current while directing its travel out of the treating bath into said jet flow to loosen the fabric material in said zigzag form to preclude entanglements, continuously discharging from said enclosed path treating liquor of the jet flow for return thereof back into the treating bath above the level of the treating bath of treating liquor and ejecting the textile material from the jet flow enclosed path when the treating liquor of the jet flow is discharged for return thereof into the treating bath, beating the textile material to preclude wrinkles being fixed therein by impacting the advancing textile material accompanied by treating liquor in an area above the level of the treating bath after ejection from the jet flow enclosed path and prior to return of the advancing textile material back into the treating bath, and after impacting the advancing textile material allowing the textile material to fall onto a perforated plate disposed extending into said treating bath and configured so that the textile material thereon is advanced without entangling,returning the textile material back into the treating bath for advancement therein.

12. A method of treating a textile material in a loop according to claim 11, including continuously advancing it through said treating bath and impacting said textile material on a surface of said enclosed path for said jet flow of treating liquor to keep it from entangling.

13. A method of treating a textile material in a loop comprising, advancing textile material longitudinally in an elongated treating bath of treating liquor gradually increasing in depth in the direction of advancement while in a loop configuration, for maintaining the textile material in residence for wet treatment in the treating bath, taking a suction from the treating bath and effecting a jet flow of treating liquor along an enclosed path outside of the treating bath for recirculating the treating liquor back to the treating bath and for advancing the textile material longitudinally through said jet flow, while the textile material is advancing directing its travel out of the bath into said jet flow, continuously discharging liquor of the jet flow from said enclosed path for return thereof back into the treating bath above the level of the treating back and continuously ejecting the textile material from the jet flow enclosed path accompanied by treating liquor when the liquor of the jet flow is discharged for return into the treating bath, impacting the advancing textile material accompanied by treating liquor in an area above the level of the treating bath and removing treating liquor therefrom after ejection from the jet flow enclosed path and prior to return of the advancing textile material back into the treating bath, and after impacting the advancing textile material allowing the textile material to fall onto a perforated plate disposed extending into said bath and configured so that the textile material thereon is advanced without entangling, returning the material back into the treating bath for advancement therein.

14. A method of rapidly and uniformly treating or dyeing a textile fabric in a continuous loop configuration comprising, advancing a textile fabric as a continuous loop with runs thereof successively advancing longitudinally in a residence bath of treating liquor contained in a partially filled elongated tubular vessel allowing transient residence of the textile fabric while advancing longitudinally approximately horizontally in zigzag form in the residence bath with controlled fabric piling and in a direction toward which the depth of the treating liquor increases gradually, said direction corresponding to the direction of advancement of the textile fabric in said residence bath, directing the advancing textile fabric out of said residence bath adjacent an end of said residence bath into a rapid jet flow of the treating liquor and into an inlet of a conduit of substantially lesser cross section than said tubular vessel outside of said residence bath and rapidly transferring the textile fabric through the conduit substantially free of zigzags under control flow of said jet flow at a speed therethrough substantially greater than the speed of advancement in said residence bath and in a direction opposite to the direction of travel of the textile fabric through said residence bath and ejecting the textile fabric and jet flow treating liquor out of an outlet of said conduit to a level above the level of the residence bath adjacent the other end of the residence bath into said tubular vessel, and controlling avoidance of entanglement of the textile fabric upon ejection thereof from said outlet of said conduit by deflecting the advancing textile fabric on a deflector surface above the level of said treating bath and adjusted angularly relative the horizontal deflecting travel of the textile fabric in dependence upon the particular textile fabric being treated for directing the longitudinal travel thereof back into said residence bath with substantially reduced possibility of tangling and with improved controlled compaction and proper piling thereof and advancing smoothly in said residence bath.

15. A method of rapidly and uniformly treating or dyeing a textile fabric in a continuous loop configuration according to claim 14, including after impacting the advancing textile fabric on said deflector surface guiding the textile fabric longitudinally into said residence bath along a guide path for a limited extent of axial travel of the textile fabric in the elongated vessel and the residence bath.

16. A method of rapidly and uniformly treating or dyeing a textile fabric in a continuous loop according to claim 15, in which said guide path receives the advancing textile fabric accompanied by treating liquor after impacting thereof on said deflector surface and guides the textile fabric along a guide surface inclined to the horizontal downwardly into said residence bath in a direction toward the direction of advancement of said advancing textile fabric.

17. A method of rapidly and uniformly treating or dyeing a textile fabric in a continuous loop configuration according to claim 16, in which said guide surface allows treating liquor to pass therethrough.

18. A method of rapidly and uniformly treating and dyeing a textile fabric in a continuous loop configuration according to claim 14, in which said textile fabric is transferred along a major length of said conduit horizontally.

19. A method of rapidly and uniformly treating or dyeing a textile fabric in a continuous loop configuration according to claim 18, in which said textile fabric enters said inlet of said conduit and is guided through an extent of advancement thereof through an angle between 30° to 60° relative to the horizontal prior to transfer in said conduit horizontally and said textile fabric is impacted against the interior of said conduit as it advances said extent.

20. A method of rapidly and uniformly treating or dyeing a textile fabric in a continuous loop configuration according to claim 14, including adjusting the tubular vessel inclination relative to the horizontal.

21. A method of rapidly and uniformly treating or dyeing a textile fabric in a continuous loop configuration according to claim 14, including developing the jet flow of treating liquor and directing it for flowing through said conduit and directing a part of said jet flow as a countercurrent flow into said tubular vessel in a direction counter to the direction of advancement of said textile fabric along a length to loosen any existing entanglements of the textile fabric, whereby the textile fabric is smoothly transferred through said conduit.

22. A method of rapidly and uniformly treating or dyeing a textile fabric in a continuous loop configuration according to claim 21, in which said directing the advancing textile fabric out of said residence bath comprises lifting the advancing textile fabric out of said residence bath into a space above the level of said residence bath, and subjecting said textile fabric to said countercurrent flow as the advancing textile fabric is lifted out of said residence bath thereby to loosen any existing entanglements to allow smoothly advancing of the textile fabric.

23. A method of rapidly and uniformly treating or dyeing a textile fabric in a continuous loop according to claim 14, in which said textile fabric is transferred through said conduit at a speed at least as high as 300 m/min.

24. A method of rapidly and uniformly treating or dyeing a textile fabric in a continuous loop according to claim 14, in which said textile fabric is transferred through said conduit at a speed ranging from 300 to 600 m/min.

25. A method of rapidly and uniformly treating and dyeing a textile fabric in a continuous loop configuration according to claim 14, in which said directing of the advancing textile fabric out of said residence bath comprises advancing the textile material along an upwardly inclined surface guiding the textile fabric upwardly to the surface of said residence bath and lifting the advancing textile fabric above the level of said residence bath, during lifting of said textile fabric subjecting it to a countercurrent flow of said jet flow of treating liquor applied in a direction opposite to the direction of advancement of the textile fabric to loosen any existing entanglement of the textile fabric for smoothly advancing of said textile fabric.

26. A method of rapidly and uniformly treating or dyeing a textile fabric according to claim 14, in which said textile fabric is impacted on said deflector surface at a speed effective to beat the textile fabric on said deflector surface and effective to avoid wrinkles on the textile fabric.

27. A method of rapidly and uniformly treating or dyeing a textile fabric according to claim 14, including developing said jet flow of said teating liquor, and heating said treating liquor prior to developing said jet flow thereof.

28. A method of rapidly and uniformly treating or dyeing a textile fabric according to claim 14, in which said treating liquor comprises a dye.

29. A method of rapidly and uniformly treating or dyeing a textile fabric according to claim 14, in which suctions are taken from said bath at points axially spaced on said tubular vessel for controlling and assisting proper piling of the textile fabric in said residence bath for smooth advancement thereof in said residence bath.

30. A method of rapidly and uniformly treating or dyeing a textile fabric according to claim 14, including adjustably inclining the residence bath relative to the horizontal for controllably optomizing reduction of the volume of the treating liquor for treating the textile fabric, thereby to optomize the economy of the method and the smoothness of advancement of the textile fabric in said residence bath.

31. A method of treating textile fabric by a wet process comprising the following steps:

1. forming an endless loop of the textile fabric for treatment by the wet process in a circular path,
2. continuously advancing the endless loop of textile fabric along the circular path through a first section of said circular path for wet treatment in a residence bath of treating liquor through which the endless loop of textile fabric is advanced in a direction of increasing depth of the bath in a zigzag configuration thereof,
3. while advancing the endless loop of textile fabric through said residence bath of treating liquor directing advancing thereof through a jet flow of some of said treating liquor,
4. advancing the endless loop of textile fabric in a direction generally opposite to the direction of the advancing thereof in said residence bath by said jet flow of treating liquor immersed in a successive section of said circular path containing the jet flow of treating liquor and at a speed substantially greater than the speed at which the textile fabric is advanced through the residence bath of treating liquor,
5. while advancing the textile fabric lifting it under control of the jet flow out of said section containing the jet flow of treating liquor into a gaseous space and while advancing it effecting beating of said textile fabric in said gaseous space under control of said jet flow while in a wet state so that wrinkles do not become fixed,
6. after beating the advancing endless loop of textile fabric returning it to said residence bath of liquor for continued advancing for wet treatment through said residence bath of liquor in said zigzag configuration,
7. repeating the steps successively for a desired number of times, and
8. removing the endless loop of textile fabric from said circular path.

32. A method of dyeing textile fabric by a wet process comprising the following steps:

1. forming an endless loop of the textile fabric for dyeing by the wet process in a circular path,
2. continuously advancing the endless loop of textile fabric along the circular path through a first section of said circular path for wet treatment in a residence bath of dye liquor through which the endless loop of textile fabric is advanced in a zigzag configuration thereof,
3. while advancing the endless loop of textile fabric through said residence bath of dye liquor directing advancing of the textile fabric through a jet flow of some of said dye liquor,
4. advancing the endless loop of textile fabric in a direction generally opposite to the direction of the advancing thereof in said residence bath by said jet flow of dye liquor immersed in a successive section of said circular path containing the jet flow of dye liquor and at a speed substantially greater than the speed at which the textile fabric is advanced through the residence bath of dye liquor,
5. while advancing the textile fabric lifting it under control of the jet flow out of said section containing the jet flow into a gaseous space at a speed effective for beating the advancing textile fabric on a stationary, surface above the level of said residence bath in said gaseous space under control of said jet flow while in a wet state so that wrinkles do not become fixed, 6. after beating the advancing endless loop of textile fabric returning it to said residence bath of dye liquor for advancing immersed through said residence bath of dye liquor in said zigzag configuration,
7. repeating the steps successively for a desired number of times, and
8. removing the textile fabric from said circular path.

33. A method of dyeing a textile fabric by a wet process according to claim 32, in which said textile fabric is impelled by said jet flow at a speed exceeding 300 meters per minute against said stationary surface, and said stationary surface is inclined downwardly relative to the horizontal to effect control of piling of said textile fabric for smooth advancement thereof in said residence bath.

34. A method of dyeing a textile fabric by a wet process comprising the following steps:

1. forming an endless loop of the textile fabric for dyeing by the wet process in a circular path,
2. continuously advancing the endless loop of textile fabric along the circular path through a first section of said circular path for wet treatment in a residence bath of dye liquor through which the endless loop of textile fabric is advanced in a zigzag configuration thereof,
3. while advancing the endless loop of textile fabric through said residence bath directing advancement thereof into a jet flow of said dye liquor,
4. advancing the endless loop of textile fabric by said jet flow of dye liquor immersed in a successive section of said circular path containing the jet flow of dye liquor and in a condition substantially free of folds and at a speed substantially greater than the speed at which the textile fabric is advanced through the residence bath,
5. while advancing the textile fabric lifting it under control of the jet flow of dye liquor out of said section containing the jet flow of dye liquor into a gaseous space against a stationary deflector at a speed effective for beating the textile fabric in said gaseous space while in a wet state so that wrinkles do not become fixed and effective to relax knitted or woven fabric when made of textured yarn,
6. after beating the advancing endless loop of textile fabric returning it to said residence bath of dye liquor for advancing thereof for wet treatment in said residence bath of dye liquor in said zigzag configuration,
7. repeating the steps successively, and
8. removing the textile fabric from said circular path.

35. A continuous method of treating or dyeing a textile fabric by a wet process comprising:

(a) forming an endless loop of the textile fabric for processing by the wet process in a circular path,
(b) continuously advancing the endless loop of textile fabric along the circular path through a section of said circular path for wet treatment in a residence bath of treating or dyeing liquor,
(c) while continuously advancing the endless loop of textile fabric through said residence bath directing advancement thereof into a jet flow of the liquor,
(d) continuously advancing the endless loop of textile fabric by said jet flow of liquor immersed in said jet flow in another section of said circular path and advancing it at a speed greater than the speed at which said textile fabric is advanced through the residence bath,
(e) while advancing the loop of textile fabric ejecting the advancing textile fabric from said another section of the circular path and lifting it under control of the jet flow and impelling the advancing textile fabric against a stationary inclined surface disposed above the level of the residence bath for spreading the textile fabric and then returning the spread textile fabric to the residence bath for advancing therein,
(f) while advancing the endless loop continuously taking suction from said residence bath of the treating or dyeing liquor therein to effectively control piling of the fabric for smooth unentangled travelling of the textile fabric in said residence bath and continuously recirculating the treating or dyeing liquor as said jet flow back into the residence bath,
(g) repeating the advancing of the loop of textile fabric through said residence bath and said jet flow,
(h) removing the textile fabric from said circular path.

36. A continuous method of treating or dyeing a textile fabric by a wet process according to claim 35 including inclining said residence bath to vary the gradually increasing depth thereof.

37. A continuous method of treating or dyeing a textile fabric by a wet process comprising:

(a) forming an endless loop of the textile fabric for processing by the wet process in a circular path,
(b) continuously advancing the endless loop of textile fabric along the circular path through a section of said circular path for wet treatment in a residence bath of treating or dyeing liquor,
(c) while continuously advancing the endless loop of textile fabric through said residence bath directing advancement thereof into a jet flow of the liquor,
(d) continuously advancing the endless loop of textile fabric by said jet flow of liquor immersed in said jet flow in another section of said circular path of substantially lesser cross section and advancing it at a speed greater than the speed at which said textile fabric is advanced through the residence bath,
(e) while continuously advancing the endless loop of textile fabric ejecting the advancing textile fabric upwardly out of said another section and impelling it with the jet flow against a preset stationary deflector surface above the level of the residence bath and spreading the textile fabric by the deflector surface and returning the continuously advancing textile fabric to the residence bath for advancement therein in a spread condition,
(f) repeating the advancing of the loop of textile fabric through said residence bath and in said jet flow,
(g) removing the textile fabric from said circular path.

38. A continuous method of treating or dyeing a textile material by a wet process comprising:

(a) forming an endless loop of the textile material for processing by the wet process in a circular path,
(b) continuously advancing the endless loop of textile material along the circular path through a section of said circular path for wet treatment in a residence bath of treating or dyeing liquor,
(c) while continuously advancing the endless loop of textile material through said residence bath directing advancement thereof into a jet flow of the liquor,
(d) continuously advancing the endless loop of textile material by said jet flow of liquor immersed in said jet flow in another section of said circular path of substantially lesser cross section and advancing it at a speed greater than the speed at which said textile material is advanced through the residence bath, (e) while continuously advancing the endless loop of textile material ejecting the advancing textile material upwardly out of said another section and impelling it with the jet flow against a preset stationary deflector surface above the level of the residence bath and spreading the textile material by the deflector surface and deflecting the textile material with said deflector surface downwardly to a perforated plate for developing successive folds in the textile material by said perforated plate, (f) returning the continuously advancing textile fabric to the residence bath for advancement therein in a spread condition and with folds developed thereon, (g) repeating the advancing of the loop of textile fabric through said residence bath and in said jet flow, and (h) removing the textile fabric from said circular path.

* * * * *